United States Patent [19]

Moschner

[11] Patent Number: 4,702,459

[45] Date of Patent: Oct. 27, 1987

[54] FENCE ASSEMBLY

[76] Inventor: Vernon D. Moschner, 1000 N. Fairlawn Cir. East, Evansville, Ind. 47711

[21] Appl. No.: 924,800

[22] Filed: Oct. 30, 1986

[51] Int. Cl.[4] ..... E04H 17/14

[52] U.S. Cl. ..... 256/19; 256/66

[58] Field of Search ..... 256/19, 65, 66

[56] References Cited

U.S. PATENT DOCUMENTS

| | | | |
|---|---|---|---|
| 1,426,215 | 8/1922 | Ravert | 256/73 X |
| 3,700,213 | 10/1972 | Blease | 256/19 |
| 4,060,222 | 11/1977 | Pitkin et al. | 403/40 X |
| 4,324,388 | 4/1982 | Klaser | 256/19 |
| 4,540,160 | 9/1985 | Zanavich et al. | 256/19 |

*Primary Examiner*—Andrew V. Kundrat

*Attorney, Agent, or Firm*—Warren D. Flackberg

[57] ABSTRACT

A fence assembly characterized by fence posts defined by adhesively assembled halved molded plastic resin portions slidable and rotatable on a rod embedded in a concrete mass at a desired location. Each of the fence posts includes one or more pockets which are adapted to receive a generally ball shaped socket disposed at each end of a crossrail, The preceding arrangement not only permits crossrail assembly at fixed fence post locations but, as well, allows for inclined positioning of the crossrails to satisfy ground contour conditions and the lateral positioning of the crossrails in the instance where sections of installed fence are angled with respect to each other. The invention obviates the need for nails, supports or the like, achieving expeditious and less costly installation, together with minimized maintenance.

5 Claims, 7 Drawing Figures

FENCE ASSEMBLY

As is known, residential fencing is in widespread use, serving both decorative and utilitarian functions. Such fencing, typically made from wood treated for permanence and stained and/or painted, is generally defined by a series of upstanding fence posts to which horizontal members or rails interconnect. A particular problem, among others, presented by existing structures is in connection with actual fence erection and/or installation, even on a level area, but compounded or more acute where the fence line is on uneven ground and/or angles.

The fence assembly presented by the invention is typically formed by combining components made from a vinyl plastic, where, importantly, assembly is representative of both ease and convenience. In other words, and by way of example, component standardization serves significant practicality, permitting ready crossrail placement irrespective of fence post locations and even in the instance of irregular terrain. Restated otherwise, a cross rail can be introduced into a cavity defined in a post and, through fence post rotation, maintained in an effective assembled relationship. Additionally, the assembled fence accommodates any angular and/or inclined position of the crossrails with respect to adjacent posts as well as where sections of the fence are angled with respect to each other.

Moreover, and by reason of component interchangeability, gates or like entries can be installed with the same simplicity provided for crossrail placement. The positive economic aspect of the invention is furthered by reason that preformed hollow vinyl plastic is employed for the respective component/members, such being readily fabricated and, thereafter, assembled and/or joined, as by the use of an adhesive.

A better understanding of the present invention will become more apparent from the following description, taken in conjunction with the accompanying drawings, wherein

Figure 1:
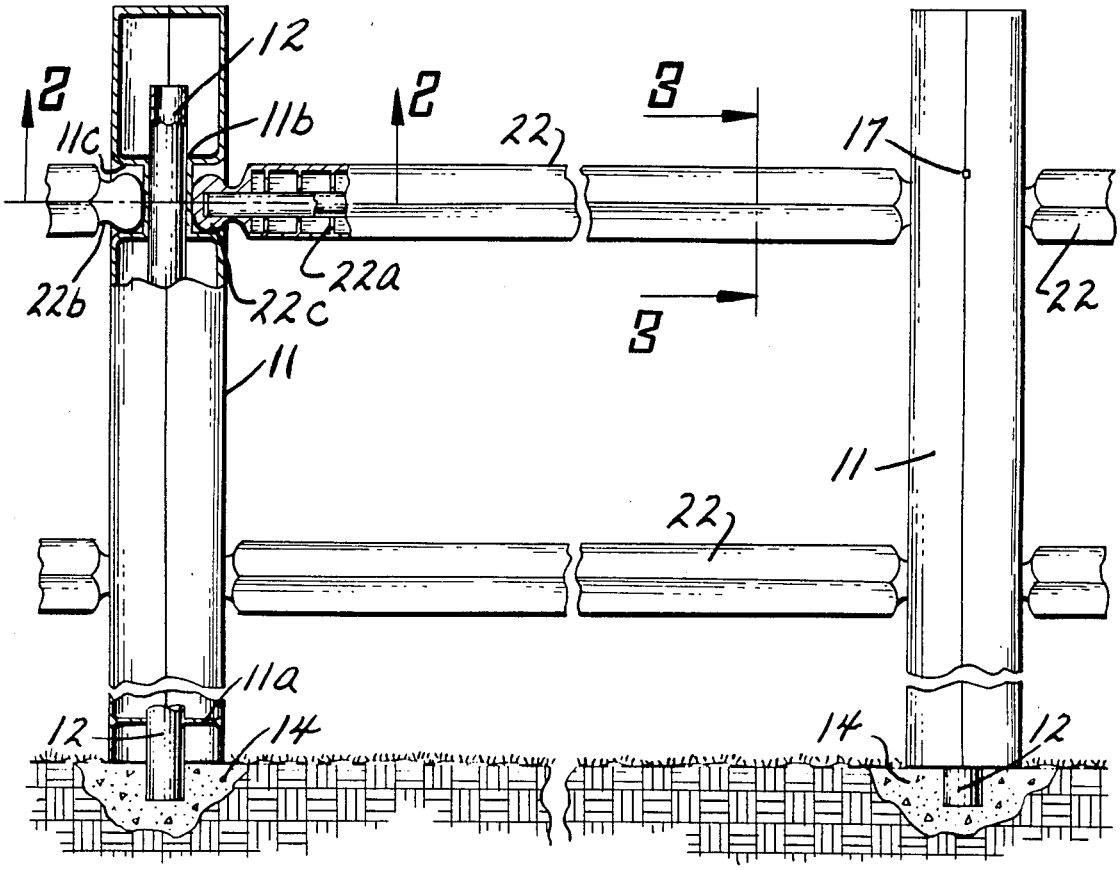
FIG. 1 is a view in side elevation showing a fence structure in accordance with the teachings of the present invention.
Figure 3:
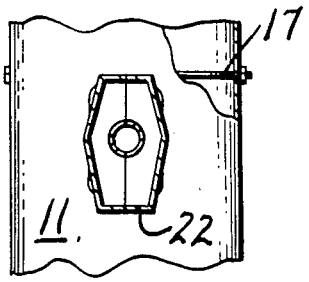
FIG. 3 is a view in vertical section, taken at line 3—3 on FIG. 1 and looking in the direction of the arrows, detailing, in this instance, a crossrail.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1, 2, 3 and 4, the fence assembly of the invention includes a combination of fence posts 11 and crossrails 22, where each of such components is defined by cooperating adhesively secured halved sections made from a molded vinyl plastic resin. Each of the aforesaid components includes ribs or webs 11*a*, 22*a* (see FIGS. 1 and 4) for strengthening purposes.

Figure 2:
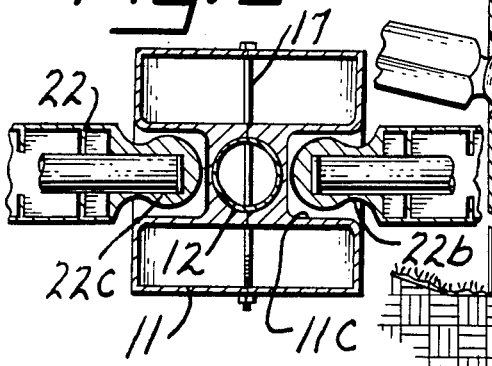
FIG. 2 is a view in horizontal section, taken at line 2—2 on FIG. 1 and looking in the direction of the arrows, detailing the instant fence structure.
Figure 4:
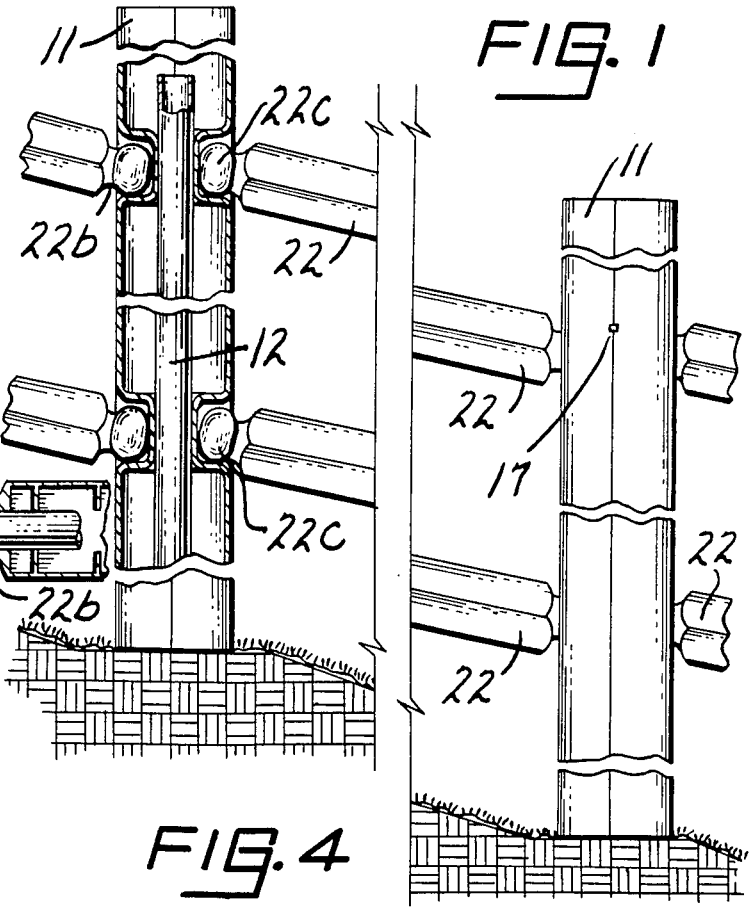
FIG. 4 is a view in side elevation, partly broken away and partly in vertical section, of a fence post and crossrail assembly in accordance with the invention, illustrating a usage where the crossrails are inclined.

In any event, and first considering a fence post 11, as illustrated in FIGS. 1, 2 and 4, such, when the respective halves are assembled, presents an axial or longitudinal opening 11*b* to receive a positioning rod 12 which extends into a concrete mass 14 for fixed fence post 11 location. A lock pin 17 is provided to maintain the fence post 11 on the rod 12 (see FIGS. 2 and 3), noting that the fence post 11 is slidable and rotatable thereon during assembly.

Each fence post half combines to present formed pockets 11*c* which may be several in number and, as well, in position, depending upon the number of fence rails 22 employed for a given fence installation. The figures illustrate a line post 11, but an end post (not shown) is similar, except for the fact that plugs (also not shown) are inserted and secured, as by an adhesive, into the available but not-to-be-used receiving pockets 11*c*. In other words, the latter serve to make the cooperable halves defining the fence post 11 suitable for both in-line and end post usage.

A similar situation exists in the instance of a corner fence post (also not shown), i.e. the receiving pockets 11*c* are in adjacent walls and not in opposite walls as in the instance of an in-line fence post. In other words, crossrails 22 are at right angles with respect to each other.

FIGS. 1, 2 and 4 disclose the relationship between assembled crossrails 22 and an in-line fence post 11, where, in FIG. 1, the crossrails 22 are generally parallel to the ground level and, in FIG. 4, the crossrails 22 are demonstrated at an inclined or sloping relationship with respect to ground contour.

In any event, each of the crossrails 22 includes a center shaft 24 positioned prior to assembly of the halved portions, serving to provide added placement weight. As further evident in the figures, the opposite ends of each crossrail 22 include a neck 22*b* terminating in a connector portion 22*c*, rounded or circular in plan view or horizontal section (see FIG. 2), i.e. to permit lateral movement of the crossrails 22, and elliptical or egg shaped in elevation or vertical section (see FIG. 1), i.e. to permit movement of each crossrail 22 from a generally horizontal position (FIG. 1) to an inclined position (FIG. 4).

In other words, a multi-directional generally ball shaped socket is provided, serving significant adaptability for a fence installation irrespective of fence post 11 (and/or receiving pocket 11*c*) location. As evident, fence assembly is accomplished without the need for nails, screws, brackets or whatever to achieve crossrail 22 placement.

In this connection, in use, and after the rods 12 for the fence posts 11 have each been set (in concrete mass 14), the fence posts 11 are positioned thereon, where the crossrails 22 are then placed between the appropriate receiving pockets 11*c*, i.e. the defined generally ball shaped sockets on the end of each are caused to enter such after each fence post 11 is established vertically. The generally ball shaped socket-receiving pocket relationship then permits rotation of the fence posts 11 to an assembled condition, where the aforedescribed generally ball shaped socket configuration permits, as well, compensation for ground level variation. In other words, the receiving pockets 11*c* together with the rotating capability of the fence posts 11, permit crossrail 22 assembly with already located fence posts 11. The procedure is completed with the securement of lock pin(s) 17.

The versatility of the invention is further evident in the showings of FIGS. 5, 6 and 7, wherein a gate 30 is illustrated in connection with an installed fence rail, such being defined by parallel gate posts 30*a* and 30*b* and connecting parallel gate crossrails 30*c* presenting, upon assembly, a rigid structure. Gate 30 is located between fence posts 11.

Figures 5, 6, 7:
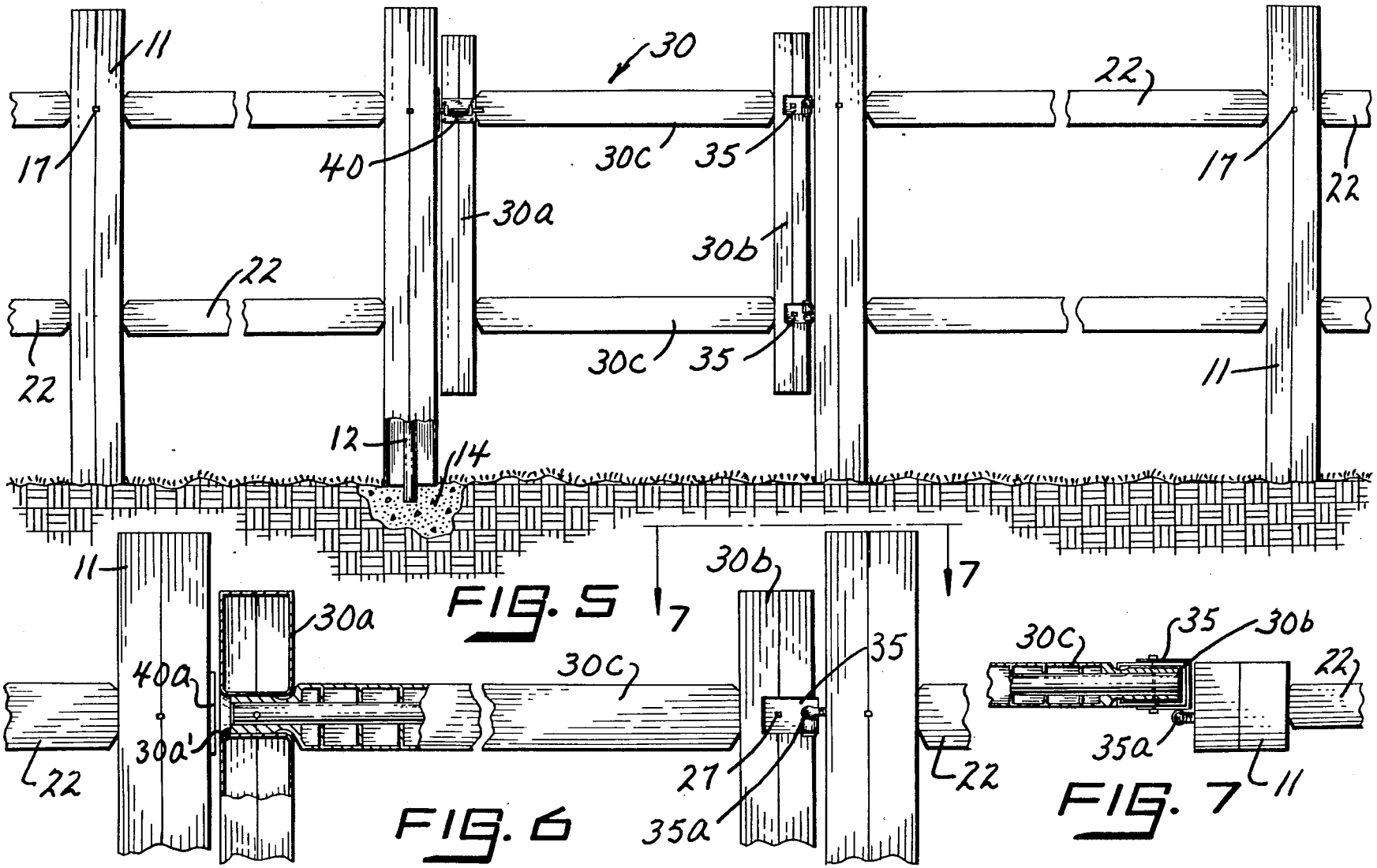
FIG. 5 is another view in side elevation, in this instance showing a gate installation for the fence assembly of the instant invention.
FIG. 6 is a fragmentary view in side elevation, partly broken away and partly in vertical section, detailing a gate assembled in accordance with the teachings of the invention; and, FIG. 7 is a top plan view, partly broken away and partly in horizontal section, taken at line 7—7 on FIG. 6 and looking in the direction of the arrows, still further detailing the gate arrangement in accordance with the invention.

As evident in FIGS. 5 and 7, in order to assemble gate 30 onto fence post 11, plugs (not shown) are introduced into the existing receiving pockets 11*c*, where a gate post hinge pin 35*a* is then threadedly secured into each. The hinge pin 35*a* forms part of a hinge structure 35 secured to a side wall of gate post 30*b*, where a lock pin 27 is provided as part of the assembly.

Gate 30 is pivotal from a closed to an open position, and conversely; however, it may be desirable to fix the gate 30 at a closed position and, in this connection, a conventional latching arrangement 40 (see FIG. 5) is provided, where the latter is affixed to a side wall of gate post 30*a*. A plate 40*a*, introduced into a receiving pocket 11*c* in fence post 11, typically serves to receive a selectively movable component of latching arrangement 40. The gate 30, therefore, is readily mounted for use and, as well, latching.

It might be noted that gate crossrail 30*c* is generally similar to crossrail 22, i.e. component-wise, where the ends thereof are positioned within receiving pockets 30*a*' in the gate posts 30*a* (FIG. 6 details one of the ends).

A keynote of the invention includes, among other features, a fence post which, through modification, serves various end usages, to-wit, in-line, corner, end, and gate mounting. Moreover, through common molding techniques, a fence assembly is provided which basically is defined by a select number of interchangeable components, meaning cost economies to the user. The fact that plastic resin is employed adds durability and also minimizes maintenance requirements.

A further keynote of the invention is the ability thereof to assume and/or conform to fence line needs irrespective of ground contour, i.e. the sections of fence can be readily angled with respect to each other, and at the same time, the crossrails may be inclined upwardly and/or downwardly. Importantly, the fence is readily assembled after the fence posts are each at a preselected fixed location due to the ability of such to be rotated, even if the sections of fence are in-line.

From the preceding, therefore, it should be evident that the fence assembly presented herein affords features in installation and usage not available heretofore in such a simplified and direct manner. The preceding arrangement is, however, susceptible to various changes within the spirit of the invention, including, by way of example, proportioning; the fact that a fence post may be rounded instead of flat sided; the precise geometry of the generally ball shaped socket, as well as the achievable lateral and vertical movement spans; the particular latching employed for the gate, including the hinge arrangement supporting the gate on a fence post; and, the like. Thus, the preceding should be considered illustrative and not as limiting the scope of the following claims:

I claim:

1. A fence assembly comprising a first fence post and a second fence post each having a side wall, and a crossrail interconnecting said first fence post and said second fence post, said side wall of each of said fence posts presenting a pocket and said crossrail having a generally ball shaped socket at each end thereof selectively and cooperatively received within said pocket, and where said generally ball shaped sockets are dimensioned to permit lateral and vertical crossrail movement, where said first fence post and said second fence post are each slidably and rotatably mounted on a shaft fixedly disposed at a desired fence post location, where the rotation of each of said fence posts permits the receiving of a crossrail at a first position and the assembly of said crossrail with said fence posts at a second position, where fastening means secure each of said fence posts at said second position after assembly, and where said fastening means extend through said shaft.

2. The fence assembly of claim 1 where said first fence post and said second fence post are each defined by halved adhesively joined longitudinally extending sections.

3. The fence assembly of claim 1 where a gate is pivotally mounted on said first fence post and extends to an adjoining fence post, said gate including gate posts and gate rails, where the ends of said gate rails extend into pockets in said gate posts.

4. The fence assembly of claim 3 where said gate posts and said gate rails are each defined by halved adhesively joined longitudinally extending sections.

5. A fence assembly comprising a first fence post and a second fence post each having a side wall, and a crossrail interconnecting said first fence post and said second fence post, said side wall of each of said fence posts presenting a pocket and said crossrail having a generally ball shaped socket at each end thereof selectively and cooperatively received within said pocket, and where said generally ball shaped sockets are dimensioned to permit lateral and vertical crossrail movement, and where said generally ball shaped socket assumes an ellliptical shape in vertical section and a circular shape in horizontal section.

* * * * *